US007122112B2

(12) United States Patent
Mukkamala et al.

(10) Patent No.: US 7,122,112 B2
(45) Date of Patent: Oct. 17, 2006

(54) COMPOUNDS CONTAINING AMIDE AND CARBOXYL GROUPS AS ASPHALTENE DISPERSANTS IN CRUDE OIL

(75) Inventors: Ravindranath Mukkamala, Lansdale, PA (US); Rajiv Manohar Banavali, Rydal, PA (US)

(73) Assignee: Rohm and Haas Company, Philadelphia, PA (US)

( * ) Notice: Subject to any disclaimer, the term of this patent is extended or adjusted under 35 U.S.C. 154(b) by 517 days.

(21) Appl. No.: 10/447,730

(22) Filed: May 29, 2003

(65) Prior Publication Data

US 2004/0238404 A1 Dec. 2, 2004

(51) Int. Cl.
*C10G 33/00* (2006.01)
*C07C 7/20* (2006.01)

(52) U.S. Cl. ..... 208/48 AA; 208/48 R; 44/331; 252/392

(58) Field of Classification Search ..... 44/331; 208/48 AA, 48 R; 252/392
See application file for complete search history.

(56) References Cited

U.S. PATENT DOCUMENTS 3,095,286 A 6/1963 Gee et al.
3,224,957 A 12/1965 Kent
4,473,491 A * 9/1984 Trautmann et al. ..... 252/392
4,622,047 A * 11/1986 Bernasconi et al. ..... 44/331
5,143,594 A * 9/1992 Stephenson et al. .... 208/48 AA
5,556,575 A 9/1996 Babaian-Kibala et al.
5,948,237 A 9/1999 Miller et al. ..... 208/22
6,402,934 B1 6/2002 Chheda et al. ..... 208/44

FOREIGN PATENT DOCUMENTS

FR 2789999 2/1999
GB 1117643 A 6/1968
WO WO 91/01970 A 2/1991
WO WO 93/14178 A 7/1993
WO WO 95/20637 8/1995

* cited by examiner

*Primary Examiner*—Glenn Caldarola
*Assistant Examiner*—Prem C. Singh
(74) *Attorney, Agent, or Firm*—Kenneth Crimaldi

(57) ABSTRACT

A composition containing: (a) 0.001% to 20% of at least one compound represented by formula (II),

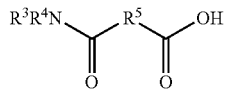

(II)

wherein $R^5$ is $C_1$–$C_{70}$ difunctional alkyl or $C_6$–$C_{14}$ difunctional aryl, and $R^3$and $R^4$ independently are hydrogen, alkyl, heterocyclic, aryl or aralkyl groups; and (b) crude oil. In addition to dispersing asphaltenes, the composition of the present invention typically also increases demulsibility, reduces viscosity, reduces sediment formation, reduces surface fouling and reduces corrosion.

8 Claims, No Drawings

COMPOUNDS CONTAINING AMIDE AND CARBOXYL GROUPS AS ASPHALTENE DISPERSANTS IN CRUDE OIL

BACKGROUND

This invention relates generally to compounds containing amide and carboxyl groups. The compounds are useful in processing of crude oil.

Certain petroleum products, including heavy crude oils, which include materials referred to as "tars," "petroleum tars" or "tar sands," are rich in asphaltenes, metals and resins. The presence of these types of compounds can lead to various problems in the recovery, transportation, treatment and refining of crude oils, including increased viscosity, formation of stable emulsions, fouling and corrosion. U.S. Pat. No. 5,948,237 discloses a particular class of α-amido carboxylic acids as asphaltene dispersants, but does not disclose the compounds used in the present invention.

The problem addressed by this invention is to find a composition suitable for improving processing of petroleum products.

STATEMENT OF INVENTION

The present invention is directed to a composition comprising: (a) 0.001% to 20% of at least one compound having: (i) at least one carboxyl group; (ii) at least one amide group; and (iii) at least fifteen carbon atoms; and (b) crude oil; provided that the compound is not represented by formula (I)

(I)

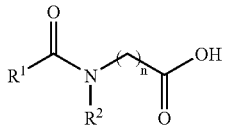

wherein $R^1$ and $R^2$ independently are hydrogen or $C_1$–$C_{22}$ alkyl and n is one or two.

This invention is directed further to a method for dispersing asphaltenes in a petroleum product. The method comprises adding to the petroleum product 0.001% to 20% of at least one compound having: (i) at least one carboxyl group; (ii) at least one amide group; and (iii) at least fifteen carbon atoms; and (b) crude oil; provided that the compound is not represented by formula (I)

(I)

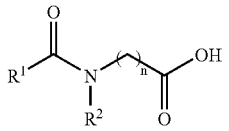

wherein $R^1$ and $R^2$ independently are hydrogen or $C_1$–$C_{22}$ alkyl and n is one or two.

DETAILED DESCRIPTION

All percentages are weight percentages based on the entire composition, unless otherwise indicated. An "alkyl" group is a hydrocarbyl group having from one to seventy carbon atoms in a linear, branched or cyclic arrangement. A "difunctional alkyl" group is an alkyl group having two points of attachment on the same or different carbon atoms, e.g., —$CH_2$—, —$CH_2CH_2$—, —$CH(CH_2CH_2CH_3)$—, and —$CH_2CH(CH_2CH_2CH_3)$—. Alkyl groups optionally have one or more double or triple bonds. Substitution on alkyl groups of one or more of halo, cyano, alkoxy, or hydroxyl groups is permitted; alkoxy groups may in turn be substituted by one or more halo substituents. A "heteroalkyl" group is an alkyl group in which at least one carbon has been replaced by O, NR, or S, wherein R is hydrogen, alkyl, heteroalkyl, aryl or aralkyl. An "aryl" group is a substituent derived from an aromatic hydrocarbon compound. An aryl group has a total of from six to twenty ring atoms, and has one or more rings which are separate or fused. A "difunctional aryl" group is an aryl group having two points of attachment, e.g., o-phenylene. An "aralkyl" group is an "alkyl" group substituted by an "aryl" group. A "heterocyclic" group is a substituent derived from a heterocyclic compound having from five to twenty ring atoms, at least one of which is nitrogen, oxygen or sulfur. Preferably, heterocyclic groups do not contain sulfur. Substitution on aryl or heterocyclic groups of one or more of halo, cyano, alkyl, heteroalkyl, alkoxy or hydroxy is permitted, with substitution by one or more halo groups being possible on alkyl, heteroalkyl or alkoxy groups. An "aromatic heterocyclic" group is a heterocyclic group derived from an aromatic heterocyclic compound. Preferably, heterocyclic groups in compounds used in this invention are aromatic heterocyclic groups.

In the present invention, at least one compound having: (i) at least one carboxyl group; (ii) at least one amide group; and (iii) at least fifteen carbon atoms; is added to a petroleum product, with the total amount of said compound(s) being from 0.001% to 20%, preferably from 0.001% to 10%, more preferably from 0.01% to 10%, more preferably from 0.01% to 1%, and most preferably from 0.02% to 0.2%. Preferably, a compound used in this invention is not in the form of a salt having an anion and a cation, i.e., a salt that is not a zwitterion; more preferably the compound is a neutral compound. Preferably, a carboxyl or amide functional group is not part of a heterocyclic ring. Preferably, a compound used in this invention is aliphatic. Preferably, a compound used in this invention is acyclic. Preferably, compounds of formula (I) for which n is from three to five also are excluded from the compounds of this invention.

A compound used in the composition or method of this invention preferably is represented by formula (II), (II)

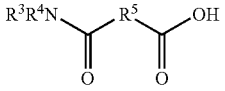

wherein $R^5$ is $C_1$–$C_{70}$ difunctional alkyl or $C_6$–$C_{14}$ difunctional aryl, and $R^3$ and $R^4$ independently are hydrogen or organic functional groups. Preferably, $R^3$ and $R^4$ independently are hydrogen, alkyl, heteroalkyl, heterocyclic, aryl or aralkyl. Preferably, at least one of $R^3$, $R^4$ and $R^5$ has at least 12 carbon atoms, and most preferably at least 15 carbon atoms.

An "organic functional group" is a functional group which does not contain metal atoms, and which has from one to seventy carbon atoms, hydrogen atoms, and optionally, contains heteroatoms, including but not limited to: nitrogen, oxygen, sulfur, phosphorus and halogen atoms. An organic functional group optionally contains double and/or triple bonds; rings, which are linked or fused; and if it is wholly or partly acyclic, the acyclic part can be linear or branched. Preferably, an organic functional group is an alkyl, heteroalkyl, aryl, aralkyl, heterocyclic or heterocyclic-alkyl group. In a preferred embodiment of this invention, at least one of the organic functional groups is a $C_2$–$C_{22}$ alkyl or heteroalkyl group, more preferably a $C_8$–$C_{22}$ alkyl or heteroalkyl group, more preferably a $C_{10}$–$C_{22}$ alkyl or heteroalkyl group, and most preferably, a $C_{16}$–$C_{22}$ alkyl group. Preferably, alkyl and heteroalkyl groups are unsubstituted. A compound used in this invention optionally contains other carboxyl or amide functional groups on one or more of the organic functional groups, preferably for a total of one to three carboxyl and/or amide functional groups. Preferably, only one carboxyl group and one amide group are present.

In a preferred embodiment of this invention, $R^5$ is $C_1$–$C_6$ difunctional alkyl in which the points of attachment are at opposite ends of the alkyl group, e.g., —$CH_2$—, —$CH_2CH_2$—, —$CH_2CH_2CH_2$— and —CH═CH—. Preferably, $R^5$ is $C_1$–$C_3$ difunctional alkyl. In another preferred embodiment of this invention, $R^5$ is $C_{11}$–$C_{19}$ difunctional alkyl in which the points of attachment are on the same carbon of the alkyl group, e.g.,

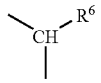

wherein $R^6$ is $C_{10}$–$C_{18}$ alkyl. Preferably, $R^6$ is $C_{16}$–$C_{18}$ alkyl.

In another preferred embodiment, $R^5$ is $C_{50}$–$C_{70}$ difunctional alkyl, preferably in which the points of attachment are on adjacent carbon atoms of the difunctional alkyl group, most preferably on adjacent carbon atoms at one end of the difunctional alkyl, i.e., —$CH_2CH(C_{50\text{-}70})$—. Compounds of this type are derived, for example, from reaction of an amine with polyisobutylene succinic anhydride, which has a polyisobutylene group having from 50 to 70 carbon atoms as a substituent on a succinic anhydride ring carbon.

In another preferred embodiment, $R^3$ is hydrogen and $R^4$ is $C_{10}$–$C_{22}$ alkyl, preferably $C_{16}$–$C_{22}$ alkyl. Preferably, $R^4$ is derived from an unsubstituted $C_{16}$–$C_{22}$ alkyl amine, $R^4NH_2$, preferably one which is an oil-soluble amine. In one embodiment, the alkyl amine is a tertiary alkyl primary amine., i.e., a primary amine in which the alkyl group is attached to the amino group through a tertiary carbon. Examples of commercially available tertiary alkyl primary amines are the Primene™ amines available from Rohm and Haas Company, Philadelphia, Pa.

In a preferred embodiment of the invention, the compound of formula (II) is selected from the group consisting of (III)

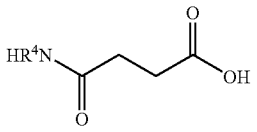

-continued (IV)

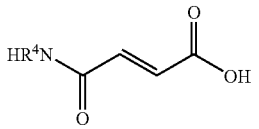

(V)

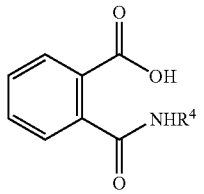

(VI)

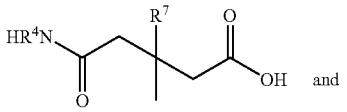

and (VII)

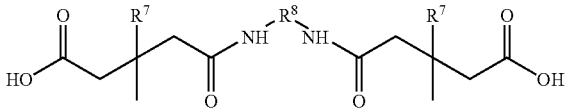

wherein $R^7$ is $C_{50}$–$C_{70}$ alkyl and $R^8$ is $C_2$–$C_{22}$ difunctional alkyl or heteroalkyl, preferably $C_2$–$C_8$ difunctional alkyl or heteroalkyl. Reaction of an alkyl amine, $R^4NH_2$ with succinic, maleic or phthalic anhydride produces a compound of formula (III), (IV) or (V), respectively. Tertiary alkyl primary amines are preferred amines for this reaction. Reaction of an alkyl amine, $R^4NH_2$ with polyisobutylene succinic anhydride (PIBSA) produces a compound of formula (VI), and reaction of a diamine $H_2NR^8NH_2$ with PIBSA produces a compound of formula (VII). In one preferred embodiment of the invention, $R^8$ is $C_4$–$C_8$ difunctional heteroalkyl, and preferably is derived from a diamine selected from among diethylenetriamine, triethylenetetramine and tetraethylenepentamine.

In addition to dispersing asphaltenes, the composition of the present invention typically also increases demulsibility, reduces viscosity, reduces sediment formation, reduces surface fouling and reduces corrosion. For crude oil recovery, the composition of the present invention can be injected directly into an injection well, or preferably diluted with solvent prior to injection. Suitable solvents include but are not limited to: petroleum distillates such as kerosene and gas oil; linear and branched aliphatic solvents such as pentane, hexane, mixtures of nonanes and 2-ethylhexanes; cycloaliphatic mixtures commonly known as naphtha; aromatic solvents such as toluene, xylenes and commercial aromatic solvent mixtures; esters; ethers; alcohols such as ethanol, isopropanol, octanol and dodecanol; ketones such as acetone, cyclohexanone and acetophenone; and other polar solvents. Preferred dilutions are 0.01 to 50 wt % of the compound in the solvent, more preferred dilutions being 0.01 to 20 wt %, more preferred dilutions being 0.1 to 10%, and most preferred dilutions being 1 to 10 wt %.

EXAMPLES

Performance Criteria and Test Methods:

Asphaltene Dispersancy-test tube method: This test requires a previously made dispersion of asphaltene in xylenes (Aromatic 150 solvent) or asphaltenic heavy crude diluted in xylenes (Aromatic 150 solvent) at a known concentration. A solution of an additive formulation (0.1 mL, the active ingredient was typically at 5–10 wt %, making the treat rate 500–1000 ppm) was taken in to a 15.0 mL graduated glass centrifuge tube, and hexanes added such that the total volume in the tube became 10.0 mL. To this mixture of additive and hexanes, asphaltenic stock solution (0.1 mL) was added. The test tube was then capped, shaken vigorously for about a minute or 40–60 times by hand and allowed to stand. The volume of any precipitated asphaltenes settled at the bottom of the tube was recorded at 10, 30, 60, 90 and 1440 (24 h) min intervals. When no additive was used, the volume of asphaltenes precipitated in the first 0.5–1 h was 0.4–0.5 mL (4–5%); in fact, it was important to initially adjust the concentration of the asphaltene stock in such a way that under these conditions of dilution with paraffinic solvents, a 4–5 vol % of asphaltenic precipitation occurred. When the additive was an effective dispersant of asphaltene, then no precipitate was formed up to 24 h (Rating=2; good). In some cases, no precipitation was observed in over 24 h to several days (Rating=2+; excellent). If the additive was not a dispersant, then an almost immediate precipitation of asphaltenes occurred (Rating=0; poor). Results for two compounds having an amide group and a carboxyl group are reported in the Table.

TABLE

| compound | | rating |
|---|---|---|
| (III) | $R^4$ = C-16-22 (derived from Primene ™ JM-T amine) formulated at 20% in AROMATIC 150 SOLVENT; treat rate: 2000 ppm | 2 |
| (IV) | $R^4$ = C-16-22 (derived from Primene ™ JM-T amine) formulated at 20% in AROMATIC 150 SOLVENT; treat rate: 2000 ppm | 2 |

The treat rate is the concentration of the compound in the crude oil.

AROMATIC 150 SOLVENT is a solvent mixture with a boiling range of 184–204° C. which contains xylene isomers, and which is available from Exxon Mobil Chemical Co., Houston Tex.

The invention claimed is:

1. A composition comprising:

(a) 0.001% to 20% of at least one compound represented by formula (II),

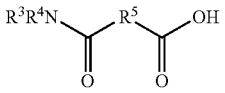

(II)

wherein $R^5$ is $C_1$–$C_{70}$ difunctional alkyl or $C_6$–$C_{14}$ difunctional aryl, and $R^3$and $R^4$ independently are hydrogen, alkyl, heterocyclic, aryl or aralkyl groups, and at least one of $R^3$, $R^4$ and $R^5$ has at least 12 carbon atoms; and (b) crude oil.

2. The composition of claim 1 in which $R^3$ is hydrogen, $R^4$ is $C_{16}$–$C_{22}$ alkyl and $R^5$ is —$CH_2$—, —$CH_2CH_2$—, —$CH_2CH_2CH_2$—, —CH═CH— or o-phenylene.

3. The composition of claim 1 in which $R^3$ and $R^4$ are alkyl and $R^5$ is $C_{11}$–$C_{19}$ difunctional alkyl with points of attachment on one carbon atom of the difunctional alkyl.

4. The composition of claim 1 in which $R^5$ is $C_{50}$–$C_{70}$ difunctional alkyl.

5. A method for dispersing asphaltenes in a petroleum product; said method comprising adding to the petroleum product 0.001% to 20% of at least one compound having formula (II),

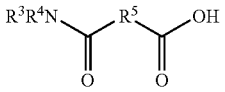

(II)

wherein $R^5$ is $C_1$–$C_{70}$ difunctional alkyl or $C_6$–$C_{14}$ difunctional aryl, and $R^3$ and $R^4$ independently are hydrogen, alkyl, heterocyclic, aryl or aralkyl groups, and at least one of $R^3$, $R^4$ and $R^5$ has at least 12 carbon atoms.

6. The method of claim 5 in which $R^8$ is hydrogen, $R^4$ is $C_{16}$–$C_{22}$ alkyl and $R^5$ is —$CH_2$—, —$CH_2CH_2$—, —$CH_2CH_2CH_2$—, —CH═CH— or o-phenylene.

7. The method of claim 5 in which $R^3$ and $R^4$ are alkyl and $R^5$ is $C_{11}$–$C_{19}$ difunctional alkyl with points of attachment on one carbon atom of the difunctional alkyl.

8. The method of claim 5 in which $R^5$ is $C_{50}$–$C_{70}$ difunctional alkyl.

* * * * *